United States Patent [19]

Will

[11] 4,288,683

[45] Sep. 8, 1981

[54] INSULATING POROUS MATRICES FOR ELECTRODE BOILERS

[75] Inventor: Fritz G. Will, Schenectady, N.Y.

[73] Assignee: General Electric Company, Schenectady, N.Y.

[21] Appl. No.: 34,373

[22] Filed: Apr. 30, 1979

[51] Int. Cl.[3] ..... H05B 3/60; F22B 1/30

[52] U.S. Cl. ..... 219/290; 204/295; 219/274; 219/292; 338/80

[58] Field of Search ..... 219/284–295, 219/271–276; 338/80–86; 204/295

[56] References Cited

U.S. PATENT DOCUMENTS

| | | | |
|---|---|---|---|
| 410,976 | 9/1889 | Kerner et al. | 204/295 |
| 512,503 | 1/1894 | Craney | 204/295 |
| 1,446,318 | 2/1923 | Penzold | 219/290 |
| 1,685,266 | 9/1928 | Baum | 219/274 |
| 1,688,679 | 10/1928 | Baum | 219/284 |
| 2,519,515 | 8/1950 | Turner | 219/274 |
| 2,663,788 | 12/1953 | Tatem | 219/290 X |
| 3,138,696 | 6/1964 | Eaton | 219/286 |
| 3,496,334 | 2/1970 | Williams | 219/288 |
| 3,792,229 | 2/1974 | Hagyard | 219/284 |
| 3,864,543 | 2/1975 | Mohr | 219/285 |
| 3,956,020 | 5/1976 | Weininger | 264/49 |
| 4,052,586 | 10/1977 | Brunner | 219/284 |
| 4,092,519 | 5/1978 | Eaton et al. | 219/284 |

FOREIGN PATENT DOCUMENTS

| | | | |
|---|---|---|---|
| 357848 | 9/1922 | Fed. Rep. of Germany | 219/284 |
| 1012354 | 4/1952 | France | 219/274 |

OTHER PUBLICATIONS

"Recent Development in Automatic Electrode Boilers", M. Eaton, The Engineering Journal, Mar. 1962, pp. 57–62.

Coates Electric, Bulletin 400, "Steam or Hot Water Electrode Boilers", Cam Industries, Kent, Washington, Feb. 15, 1975.

*Primary Examiner*—A. Bartis

*Attorney, Agent, or Firm*—Jane M. Binkowski; James C. Davis, Jr.; Leo I. MaLossi

[57] ABSTRACT

An electrode boiler has a pair of boiler electrodes defining a volume therebetween to be filled with electrolyte to be heated by electrical current passage between the electrodes through the electrolyte. A porous insulating matrix is confined by a pair of porous insulating support walls between but spaced apart from said electrodes in the volume occupied by said electrolyte. The space between said walls is filled with a plurality of insulating members, thereby providing paths exhibiting increased resistance to electrical current flow relative to the electrical resistance of the electrolyte located between said electrodes and said support walls in the direction perpendicular to said support walls. The insulating members may comprise spheres, pellets or cylindrical rods or tubes made of glass, polymeric material, ceramics or the like. The space between each electrode and the respective juxtaposed support wall is free of insulating members and forms a zone of considerably lower resistance which reduces steam formation and arcing at the electrode surface.

20 Claims, 12 Drawing Figures

INSULATING POROUS MATRICES FOR ELECTRODE BOILERS

BACKGROUND OF THE INVENTION

This invention relates generally to electric steam boilers, and more particularly to an electrode boiler having a heating zone defined by a pair of spaced support walls within which is located a plurality of insulating members which create a high resistance to electrical current flow in a direction perpendicular to the support walls.

In immersion-type electrode boilers, electrodes connected to an appropriate source of electrical power are either completely or partially immersed within an electrolyte to be heated. The electrical current density at the electrode surfaces must be kept below that at which unacceptable electrochemical corrosion of the electrodes would occur. As electrical conductivity of the electrolyte increases (e.g., by use of high conductivity ("dirty") water), resistance to flow of electrical current decreases so that the current density within the electrolyte, and consequently at the electrode surfaces, increases. The maximum current density tolerable by the material of the boiler electrodes requires use of purified water, or at least water having a conductivity no greater than a certain predetermined level, when using prior art immersion-type electrode boilers.

A number of techniques have been applied in the prior art, as described in U.S. patent application Ser. No. 032,116 filed Apr. 23, 1979, of T. A. Keim, assigned to the instant assignee, and incorporated herein by reference, to attempt to limit current density within the boiler cell to a level tolerable by the boiler electrodes. The above-mentioned U.S. patent application Ser. No. 032,116 describes a system of insulators designed to limit the current path volume within the electrolyte, so that the maximum current density within the electrolyte would not exceed that tolerable by the boiler electrodes.

An object of the instant invention is to provide tortuous high resistance paths to electrical current flow in the direction between the boiler electrodes, and simultaneously to provide paths for steam bubble removal in the direction generally perpendicular to the direction of current flow through the electrolyte.

A further object of the instant invention is to provide an electrode boiler configuration in which steam generation is confined to a volume separated from the electrodes of the boiler.

A further object of the instant invention is to provide a boiler system whose electrical resistance can be readily changed to accommodate a variety of electrolyte conductivities.

SUMMARY OF THE INVENTION

The invention described herein includes a first electrode having a major surface area as an electrolyte contact surface and a second electrode having a major surface area as an electrolyte contact surface spaced from said first electrode contact surface to define a volume between said surfaces to be filled with electrolyte to be heated, and first and second spaced, porous support walls disposed between said electrodes and spaced therefrom, each support wall having a major surface in juxtaposition with one of said major surfaces of said first and second electrodes. A plurality of electrically insulating members is disposed between said support walls to restrict the current-carrying volume of the electrolyte within the space between the support walls, to thereby limit current flow through the electrolyte to a value within the maximum allowable current density for the electrodes. The porous insulating matrix is spaced apart from the electrodes, so that boiling of the electrolyte can be confined to the volume contained in the matrix. In a preferred embodiment, a plurality of insulating cylindrical rods are disposed between said walls generally parallel to each other.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

MANNER AND PROCESS OF MAKING AND USING THE INVENTION

The specific features of the instant invention described herein and shown in FIGS. 1–7 are merely exemplary, and the scope of the invention is defined in the appended claims. Throughout the description and FIGS. 1–7, like referenced characters refer to like elements of the invention.

Figure 1:
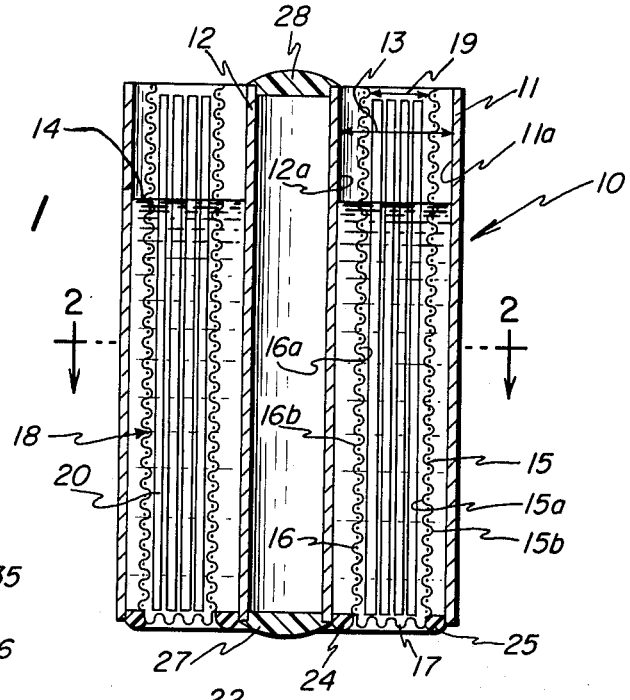
FIG. 1 is a schematic cross-sectional view showing an electrode boiler configuration of the instant invention.
Figure 2:
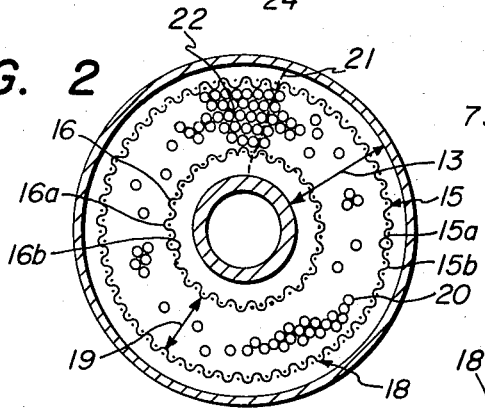
FIG. 2 is a cross-sectional view taken along line 2—2 of FIG. 1.

FIGS. 1 and 2 show an electrode boiler 10 of the instant invention. A generally cylindrical electrode 11 having major surface 11*a* and a concentric generally cylindrical electrode 12 spaced therefrom having major surface 12*a* define a volume 13 therebetween, within which an electrolyte 14 to be heated by passage of electrical current therethrough is disposed. A wall 15 having major surfaces 15*a*, 15*b*, of porous, insulating material is disposed such that major surface 15*b* is in juxtaposition with and spaced from major surface 11*a* of electrode 11, and wall 16 having major surfaces 16*a*, 16*b* is disposed such that major surface 16*a* is radially within, in juxtaposition with, and spaced from major surface 15*a* of wall 15 and major surface 16*b* is spaced radially outward from, and in juxtaposition with major surface 12*a* of electrode 12. A bottom wall 17 of porous, insulating material may connect walls 15 and 16 to form a basket 18. Walls 15 and 16 define a volume 19 therebetween within which the electrolyte heating is to be concentrated.

During operation, volume 13 between surfaces 11*a*, 12*a* of electrodes 11, 12, respectively, will be filled to the desired level with an electrolyte 14 to be heated by passage of electrical current between electrodes 11, 12 through the electrolyte. The amount of heating produced in the electrolyte is a function of the resistivity of the electrolyte and the electrical current level within the electrolyte volume. At a given current level within the electrolyte, output of the boiler cell (i.e., heat input by joulean heating of the electrolyte) can be increased by raising the electrical resistance of the electrolyte. Alternatively, electrical current density within the electrolyte can be increased to increase output of the cell. However, the maximum current density tolerable by the electrodes, usually made of stainless steel, places a practical limit upon current density, as described in the aforementioned patent application of Keim, Ser. No. 032,116.

In order to increase the electrical resistance to current flow in the volume 19, a plurality of insulating members are disposed within the volume 19, thereby reducing the available current-carrying volume of electrolyte 14 within volume 19. In embodiments shown in FIGS. 1 and 2, a plurality of cylindrical rods 20 of electrically insulating material are disposed in close packed configuration within volume 19. As shown by line 21 in FIG. 2, the path of electrical current flow between electrode 12 and electrode 11 is a tortuous path through spaces 22 separating rods 20. The resistance to current flow is dependent upon the packing density (i.e., percentage of volume 19 occupied by insulator rods) of cylindrical rods 20 within volume 19 of basket 18. As the rods are more tightly packed, the width of the opening between rods at the line of closest approach narrows, and thereby the resistance to electrical current flow is increased.

Plastic plugs 27, 28 could be inserted into the ends of the center cylindrical electrode 12 to prevent flow of electrolyte into the center of the electrode and also to eliminate fringing or end effect at the ends of the electrode cell. Alternatively, an insulating end plate may be placed at the bottom end of the electrodes to prevent any current concentration which could promote corrosion at those sites, from appearing at those points of the electrodes.

Figure 3C:
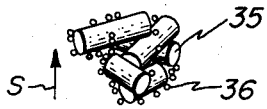
FIG. 3*c* is a schematic enlarged view of a portion of an embodiment of the present electrode boiler utilizing insulating cylindrical pellets.
Figure 3E:
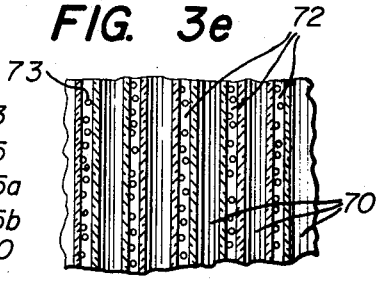
FIG. 3*e* is a schematic enlarged cross-sectional view of an embodiment of the present electrode boiler utilizing insulating hollow elongated cylindrical glass tubes.
Figure 3A:
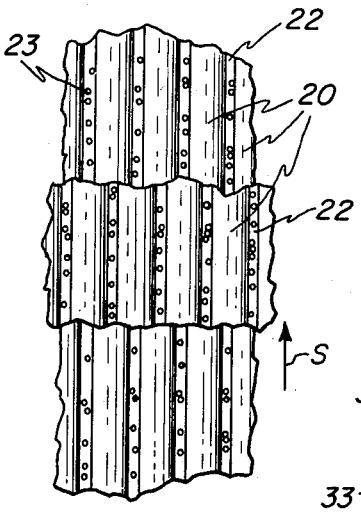
FIG. 3*a* is a schematic enlarged cross-sectional view of a portion of the embodiment of the present electrode boiler utilizing a plurality of insulating cylindrical rods.

As illustrated in FIG. 3*a*, spaces 22 have small areas relative to the cross section of rods 20, thereby raising the resistance to electrical current flow between the electrodes by reducing the available current-carrying volume. As the spaces 22 are reduced in size by raising packing density of the rods 20, the resistance to current flow increases. In the limit, if rods 19 were packed and bonded to eliminate spaces 21 the resistance to current flow would be infinite, and the boiler would be shut down. However, short of this theoretical highest packing density, increased packing density raises the resistance and allows use of higher conductivity electrolyte in the boiler.

As shown in FIG. 3*a*, steam bubbles 23 rise in a direction generally parallel to the longitudinal axes of rods 20 in the direction shown by arrow S. To replace electrolyte lost by boiling off as steam, a conventional electrolyte supply provides a flow of electrolyte from the bottom of cell 10 through bottom wall 17 of basket 18, or from the top of volume 13. Gaskets 24 and 25 as shown in FIG. 1, prevent flow of electrolyte through the spaces between basket bottom wall 17 and electrodes 12 and 11, respectively, and prevent excessive current flow at the ends of rods 20.

Figure 3B:
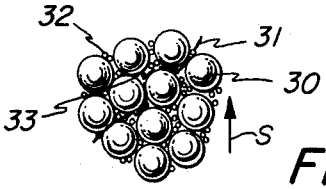
FIG. 3*b* is a schematic enlarged view of a portion of an embodiment of the present electrode boiler utilizing a plurality of insulating spheres.

Alternative porous matrix assemblies are shown in FIGS. 3*b*, 3*c* and 3*d* and 3*e*. In FIG. 3*b* a plurality of insulating spheres 30 are shown greatly enlarged. The spheres could be placed into basket 18 to present a tortuous, high resistance path 31 to current flow in the direction of a line connecting electrodes 11 and 12. Although a single size of spheres is shown in FIG. 3*b*, a plurality of sphere sizes could be used along with shakedown techniques to increase packing density of the spheres within the basket. By so increasing packing density the resistance to electrical current flow through the electrolyte filling the spaces between adjacent spheres would be increased, and heat input to the electrolyte also thereby increased, at constant electrode current. Steam would rise as small bubbles 32 in a tortuous vertical path through the spaces 33 within the sphere bed in the direction shown by arrow S.

In FIG. 3*c* a small portion of a bed of insulating cylindrical pellets 35 is shown. In a matrix using cylindrical insulating pellets, by using a positioning technique which would result in approximately a statistically random positioning of the pellets, a packing density somewhat lower than that for spheres (i.e., 30%) could be achieved. By using multiple sizes and an appropriate shakedown procedure the packing density of the pellets could be increased, but the precise porosity would have to be measured experimentally. Again, steam bubbles 34 would rise generally vertically in the direction of arrow S through the spaces between the pellets to escape from the heating zone.

Figure 3D:
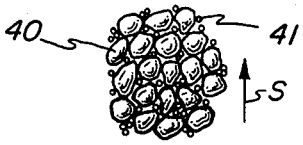
FIG. 3*d* is a schematic enlarged view of an embodiment of the present electrode boiler utilizing insulating irregularly shaped pellets.

In FIG. 3*d* irregularly shaped pellets 40 are shown. Pellets 40 could be any insulating material, including rocks or pebbles and irregularly shaped pellets of polymeric material. Steam bubbles 41 would rise in the direction of arrow S between the pellets along a tortuous path.

In FIG. 3*e* the electrically insulating members are shown as hollow elongated cylindrical glass tubes 70 aligned generally vertically. As shown in FIG. 3*e*, steam bubbles 73 rise in spaces 72 in a direction shown by arrow S generally parallel to the longitudinal axis of the rods.

Figure 4:
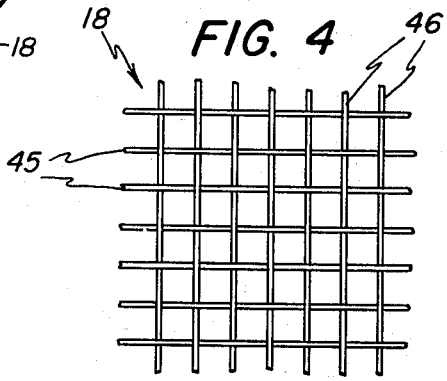
FIG. 4 is a schematic partial view of a preferred containment wall structure for the insulating matrix of the instant invention.

In FIG. 4 is shown a plan view of the wall structure of a woven basket 18 of the type used in my invention. The wall structure of basket 18 comprises a woven mesh of polymeric material of a suitable type to withstand use in an electrode boiler environment. The spacing of strands 45, 46 of the woven wall material can be selected to accommodate the size of insulating members to be located within the basket. For example, if small spheres or pellets are to be used a fine mesh will be required to positively confine the insulating members. However, if cylindrical rods of a length equal to the full length of the electrodes are to be used, a large mesh basket would be sufficient to support and define the cylindrical rods.

Figure 5A:
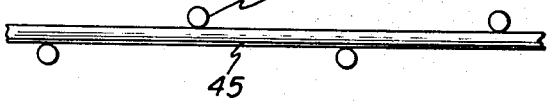
FIGS. 5*a* and 5*b* are partial edge views of preferred wall structures for containing the insulating matrix of the instant invention.
Figure 5B:
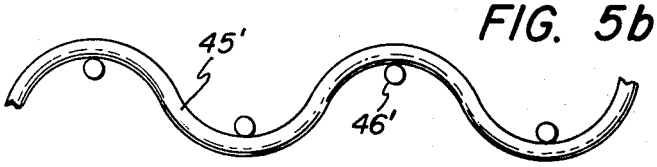

FIG. 5*a* shows one possible end view of a basket wall of the type used in my invention. FIG. 5*b* shows a corrugated wall structure of woven strands 45' and 46' which would exhibit higher mechanical strength than a straight wall basket, and would be preferable when using spheres or pellets being shaken down and packed tightly, and also may be preferable when using a high packing density for cylindrical rods. Alternatively, the basket could comprise a pair of circular sheets having appropriate openings therein to allow flow of electrolyte and electrical current into the space between the walls. The basket wall could be further reinforced by placing a helically wrapped spiral thread or strand of insulating material around the periphery of each of walls 15, 16 of basket 18. Reinforcing connectors through volume 19 are undesirable, because voids within the electrolyte adjacent the reinforcements would provide straight line paths of low electrical resistance through volume 19.

The walls of the basket are separated from the surfaces of electrodes 11 and 12, respectively, by a distance of approximately 0.50 to 5.00 centimeters to define completely electrolyte-filled gaps between the electrode surfaces and the basket. The larger cross section of electrolyte relative to that within volume 19 results in a considerably lower electrical resistance in the gaps, and thus prevents steam formation at the electrode surfaces. Providing these gaps also lessens the chance of harmful arcing at the electrodes.

The fraction of void space or "porosity" of the matrix determines to a large extent the electrical resistance of the electrolyte contained in the matrix. A matrix consisting of spheres of uniform size in a close-packed arrangement will exhibit a porosity of approximately 30%, independent of the particular sphere diameter selected. If spheres of multiple diameters were selected, higher packing densities, and therefore lower porosities would result, due to the tendency of small spheres to occupy the open spaces between large spheres.

A matrix consisting of cylindrical rods of non-porous tubes aligned generally parallel with the two cylindrical electrodes and closely spaced would exhibit a porosity of approximately 10 percent, independent of rod diameter. As with spheres, if rods of multiple diameters were selected packing density would be affected by the tendency of small diameter rods to occupy the spaces between large diameter rods. As the packing density increases, the electrical resistance increases much more rapidly than the packing density, since it is predominantly determined by the resistances at the lines of closest approach 21 between adjacent rods within the matrix. For intimately touching rods, the resistance would be infinite despite the fact that the packing density is only 90%; that is, 10% of the matrix volume is filled with electrolyte.

As will be readily apparent, the cylindrical rods exhibit the advantageous feature of providing low resistance to the flow of electrolyte in the vertical direction while at the same time providing a high resistance to electrical current flow in a direction generally perpendicular to the surfaces of the two electrodes. This facilitates collection of steam at the top of the boiler. As shown in FIG. 3*a*, steam bubbles 23 rise vertically and freely in the spaces 22 between the insulating rods. As can be seen in FIGS. 3*b*, 3*c* and 3*d*, the steam bubbles 32, 36 and 41, respectively, must follow a tortuous path in traveling between the packed spheres or pellets to escape from the matrix. Therefore, it can readily be seen that the choice of insulators is a balancing between ease of assembly which would favor the spheres or pellets versus the packing density required in a particular application.

By introducing a porous, insulating matrix as described above between and spaced from the electrodes of an electrode boiler, a substantial increase in the electrolyte conductivity can be accommodated without affecting the power level of the boiler. Therefore, the boiler can be adapted to high conductivity electrolyte (e.g., dirty water) without changing the electrode or boiler dimensions or the power dissipation; that is, the amount of steam produced per unit time. It is a significant advantage of a boiler to be able to use "dirty" water or other high conductivity electrolyte, since purifying water and restricting boiler operation to pure water use only, add significantly to the cost of operation of the boiler.

The power dissipation, or rate of steam formation, can be selected within certain bounds by properly choosing the matrix porosity, for given electrode dimensions and water conductivity. Increasing the packing density, and thereby reducing the porosity, raises the electrical resistance to current flow through the electrolyte within the matrix to increase power dissipation at constant current.

For example, in an electrode boiler employing electrodes having a height of 42 centimeters, the inner electrode having an outer diameter of 16.8 centimeters, and the outer electrode having an inner diameter of 50 centimeters using typical "clean" water having a resistivity of 20,000 ohm-centimeters (conductivity 50 micromhos per centimeter), the resistance between the electrodes is 82.6 ohms, and the power dissipation is 1.2 megawatts for an applied voltage of 10,000 volts. Using a basket as described in my invention having its vertical walls spaced 1 centimeter from each of the two electrodes, and filled with spheres of a uniform size in a close-packed arrangement (i.e., approximately 30% porosity) results in the same minimum resistance of 82.6 ohms, but with an electrolyte resistivity of 6800 ohm-centimeters. The minimum resistance is determined by calculating the volume of electrolyte within the matrix and ignoring the fraction of the volume statistically displaced by steam bubbles at any given time during operation of the boiler. Thus, it can be seen that even with this relatively "open" matrix an electrolyte with a higher conductivity can be accommodated without exceeding the maximum current density tolerable by the electrodes.

Figure 6:
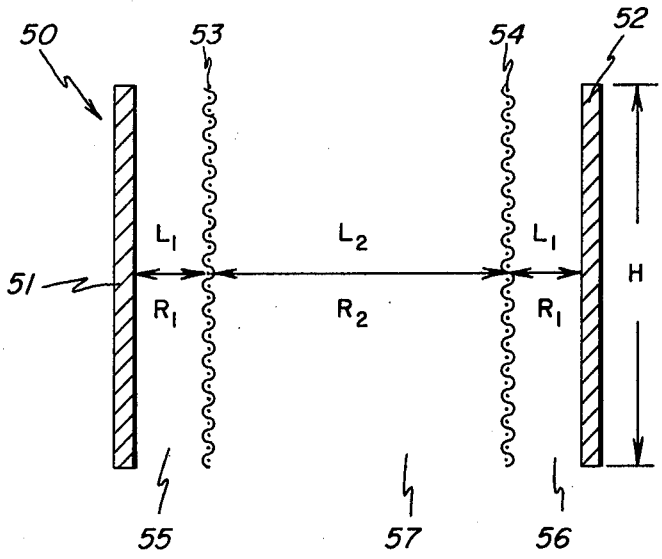
FIG. 6 is a schematic illustration of an alternative arrangement of the parts of the instant invention.

My invention could be applied to apparatus using electrodes other than conventional cylindrical electrodes. For example, I performed the following test, using flat plate electrodes 51, 52 as shown in FIG. 6 having height, H, of 12 cm and width of 1.65 cm in a plane perpendicular to the paper and spaced 8 cm apart. A basket with walls 53, 54 spaced 5 cm apart was positioned between electrodes 51, 52 with a 1.5 cm spacing between each of electrodes 51, 52 and the basket walls 53, 54, respectively. With no insulators in the basket, and the space between electrodes filled with 0.01 N KOH (0.01 Normal, potassium hydroxide), the total cell resistance was:

$$R_{tot} = 220\Omega \ (ohms)$$

When the basket was loosely filled with cylindrical glass rods disposed vertically within the basket in space 57 the measured cell resistance was:

$$R^{(M)}_{tot}=980\Omega$$

where $R^{(M)}_{tot}$ is the total cell resistance with an insulating matrix in volume 57. By inserting two more glass rods into the basket, the rods were tightly packed within the basket, and the resistance was:

$$R^{(M)}_{tot}=1030\Omega$$

From this arrangement the following calculations may be made:

$$R_{tot}=R_2+2R_1$$

where $R_1$ is the total resistance of the electrolyte volume in spaces 55, 56 between each electrode 51, 52, respectively, and the basket, and $R_2$ is the total resistance of the electrolyte volume within space 57 within the basket.

$$R_{tot}=\rho L/A$$

where $\rho$ is the resistivity of the electrolyte, L is the cell length and A is the cross-sectional area of the cell. When no matrix is within the basket, the resistivity is assumed to be uniform over the length L of the cell; therefore, $$\rho = \frac{R_{tot}A}{L} = \frac{1.65\text{ cm} \times 12\text{ cm}}{8\text{ cm}} R_{tot} \cong 2.5\ R_{tot}.$$

With the above-measured value of cell resistance $$\rho=2.5\times220\Omega\text{ cm}=550\Omega\text{ cm}$$

The resistance of each of spaces 55 and 56 would be $$R_1=1.5/8R_{tot}=0.1875\times220\cong41\Omega$$

$$R_2=R_{tot}-2R_1=220-(2\times41)=138\Omega$$

With the rod matrix in place $$R^{(M)}_{tot}=R_2^{(M)}-2R_1-1030-82=948\Omega$$

where $R_2^{(M)}$ is the resistance of the volume 57 with an insulating matrix in place and the ratio $$R_2^{(M)} / R_2 = \frac{948}{138} \cong 6.9.$$

The total cell volume $v_{tot}$ for the cell is $$v_{tot}=(1.65\times12\times8)\text{cm}^3=158.4\text{ cm}^3$$

Using 30 glass rods with a 5 mm diameter, the rod total volume, $v_{rods}$, is $$v_{rods}=30\times\pi r^2=30\times\pi\times0.25^2\times12\text{ cm}^3$$

$$v_{rods}\cong70.7\text{ cm}^3$$

The volume of each of spaces 55, 56, $v_1$, is $$v_1=1.5\times12\times1.65=29.7\text{ cm}^3$$

and the volume, $v_2$, within the walls 53, 54 is $$v_2=v_{tot}-2v_1=158.4-59.4=99\text{ cm}^3$$

Then, the volume, $v_2^{(M)}$ of electrolyte in space 57 when the rod matrix is in place is $$v_2^{(M)}=99-70.7=28.3\text{ cm}^3,$$

and $$\frac{v_2^{(M)}}{v_2} = \frac{28.3}{99} \cong 0.286.$$

Thus, the introduction of the rods has reduced the electrolyte volume by a factor of approximately 3.5, and increased the resistance by a factor of 6.9. This reflects the strong effects of the high resistances at the lines of closest approach between abutting rods, which raises electrical resistance more than proportionally with the reduction of electrolyte volume.

Figure 7:
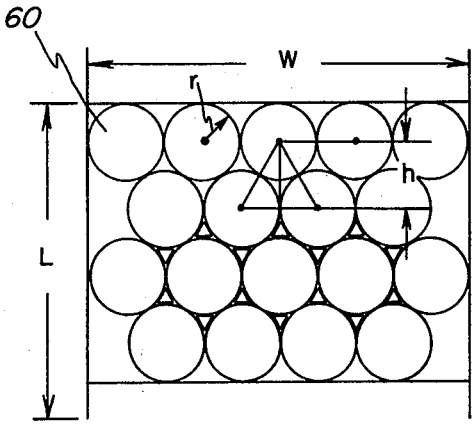
FIG. 7 is a schematic illustration of an arrangement of insulators in a boiler cell.

In an assembly of cylindrical rods 60 as shown in FIG. 7, the porosity may be determined as follows. In the width W the number of cylindrical rods, $N_W$, is $$N_W=W/2r$$

where r is the cylindrical rod radius.

In the length L the number of cylindrical rods, $N_L$, is determined by the linear separation, h, of cylindrical rod centers and $$N_L = \frac{L}{h} = \frac{L}{r\sqrt{3}}, \text{ since}$$

$$h = \sqrt{(2r)^2 - r^2} = \sqrt{3r^2} = r\sqrt{3}$$

Thus, the total number of rods, N, in an area L×W is $$N = N_W \times N_L = \frac{WL}{2r^2\sqrt{3}}.$$

The total area of the space is $A_t$=WL. The total cylinder area is $$A_c = \pi r^2 N = \frac{\pi r^2 WL}{2r^3\sqrt{3}} = \frac{\pi WL}{2\sqrt{3}}.$$

The porosity is stated as follows:

$$p = \frac{\text{void area}}{\text{total area}} = \frac{A_t - A_c}{A_t}$$

$$p = \frac{WL - \frac{\pi WL}{2\sqrt{3}}}{WL} = 1 - \frac{\pi}{2\sqrt{3}}$$

$$p \cong 1 - 0.907 \cong 0.1 = 10\%.$$

Therefore, assuming uniform diameter cylindrical rods with uniform surfaces, tight packing can reduce electrolyte volume by a factor of approximately 10. By analogy with the experiment, the resistance of the cell would rise by a factor of approximately 20. Experimental measurement shows that a factor of 25 to approximately 100 is achievable by very tight packing to further reduce the current-carrying volume of electrolyte at the lines of closest approach. A conductivity of 2,000 μmho/cm, i.e., dirty water, can therefore be accommodated by my invention.

My invention also allows adjustment of cell resistance as described for changing electrolytes. If an electrolyte of a relatively low conductivity were used, spheres or pellets or loosely packed cylinders would suffice. As electrolyte conductivity increases, the embodiments exhibiting the higher gain in resistance of the cell would be required. The aligned cylinders provide the highest resistance arrangement due to the lines of closest approach as opposed to the points of closest approach available with spheres or pellets. Further, the number of cylinders can be increased or decreased to limit the resistance to electrical current flow to accommodate higher or lower conductivity electrolytes, respectively.

An inherent advantage of a rod matrix over the sphere or pellet matrix is the low resistance to flow of water and steam bubbles in the vertical (axial) direction, facilitating electrolyte supply and steam collection as well as providing high resistance current paths between the electrodes. The preferred materials for construction of the insulating members include glass, ceramics and polymeric materials such as polypropylene, partially or completely chlorinated, fluorinated polyolefins, nylon, polyethers, polyesters, polysulfone and the like. The basket can be constructed of any of the above-named polymeric materials, or of fiberglass. Alternatively, a metallic wire basket coated with an insulating material, including the polymeric materials listed above, sprayed alumina or the like, could be used. A criteron useful in selecting a material for the basket, and to a lesser extent for the insulating members of the matrix is the ability of the material to withstand impact, thereby reducing the need for extreme care in positioning the basket between the boiler electrodes.

Boiler cells each having a matrix as described herein may be arranged in a configuration having a plurality of said cells connected to a three-phase power system, as described in the above-mentioned patent application Ser. No. 032,116. A number of cells of the type described could be used as required by the electrical network available to supply power to the system and to match the electrolyte supply and steam collection equipment available. In these systems the cells could be contained within a single pressure vessel or could be supplied with separate pressure vessels and appropriate connections for power and electrolyte supply and steam collection.

BEST MODE

The best mode contemplated for application of my invention employs concentric electrodes as shown in FIGS. 1 and 2. The basket is made of polypropylene with its walls of a corrugated woven structure as shown in FIG. 5*b*. Solid cylindrical rods of polypropylene are used as the matrix and are generally aligned with the axis of the concentric electrodes, and are relatively closely packed to a porosity of approximately 10%. The preferred electrolyte is trisodium phosphate salt in water having a resistivity of between about 500 and 5,000 ohm-centimeters.

I claim as my invention:

1. An electrode boiler comprising:

a first electrode having a major surface area;

a second electrode having a major surface area, said first and second electrodes being arranged in spaced relationship with said major surface areas in juxtaposition;

first and second spaced, porous electrically insulating support walls disposed between and spaced from each of said electrodes, each support wall having a major surface, said first support wall being disposed such that its major surface is in spaced juxtaposition with said major surface area of said first electrode, and said second support wall being disposed such that its major surface is in spaced juxtaposition with said major surface area of said second electrode; and a plurality of electrically insulating members disposed between said walls, said members being arranged to provide paths exhibiting a high resistance to electrical current flow along a direction generally perpendicular to said major surfaces of said walls and paths exhibiting a low resistance to fluid flow along a direction generally parallel to said major surfaces of said walls; the space between each electrode and the respective juxtaposed support wall being free of said insulating members to form a considerably lower electrical resistance zone which reduces steam formation and arcing.

2. The apparatus of claim 1 wherein said first electrode comprises a first elongated hollow cylindrical electrode having a predetermined outside diameter; said second electrode comprises a second elongated hollow cylindrical electrode having an inside diameter greater than said predetermined outside diameter of said first electrode; said second electrode being disposed concentrically with and in axial alignment with said first electrode; and said first and second support walls comprise spaced elongated cylindrical support walls joined by a bottom wall, thereby providing a cylindrical basket disposed concentrically with and in axial alignment with said first and second electrodes.

3. The apparatus of claim 2, wherein said insulating members comprise glass spheres.

4. The apparatus of claim 2 wherein said insulating members comprise spheres of polymeric material.

5. The apparatus of claim 2 wherein said insulating members comprise glass cylindrical pellets.

6. The apparatus of claim 2 wherein said insulating members comprise cylindrical pellets of polymeric material.

7. The apparatus of claim 2 wherein said porous support walls and bottom wall are made of an open woven mesh of polymeric strands.

8. The apparatus of claim 7 wherein said walls have corrugations running generally vertically.

9. The apparatus of claim 7 wherein said polymeric material is selected from the group consisting of polypropylene, fluorinated polyolefins, nylon, polyethers, polyesters, and polysulfone.

10. The apparatus of claim 2 wherein said support walls and bottom wall are made of metal wire strands coated with a polymeric material.

11. The apparatus of claim 2 wherein said insulating members comprise solid elongated cylindrical glass rods aligned generally parallel to the major surface areas of said electrodes.

12. The apparatus of claim 2 wherein said insulating members comprise hollow elongated cylindrical glass tubes aligned generally parallel to the major surface areas of said electrodes.

13. The apparatus of claim 2 wherein said insulating members comprise elongated cylindrical rods of a polymeric material selected from the group consisting of polypropylene, fluorinated polyolefins, nylon, polyethers, polyesters and polysulfone, said rods being disposed generally parallel to the major surface areas of said electrodes.

14. The apparatus of claim 2 wherein said insulating members comprise elongated cylindrical rods aligned generally parallel to the major surface areas of said electrodes.

15. The apparatus of claim 14 wherein said insulating members comprise elongated cylindrical rods of polymeric material selected from the group consisting of polypropylene, fluorinated polyolefins, nylon, polyethers, polyesters, and polysulfone.

16. The apparatus of claim 15 wherein said rods have a total volume of approximately ninety percent of the volume of said basket.

17. The apparatus of claim 2 wherein said major surface of said first support wall is spaced approximately 1 centimeter from said major surface of said first electrode, and said major surface of said second support wall is spaced approximately 1 centimeter from said major surface of said second electrode.

18. The apparatus of claim 2 wherein an electrolyte having a resistivity in the range of about 500 to about 5000 ohm-centimeters is disposed in the space between the major surfaces of said electrodes.

19. The apparatus of claim 1 wherein said insulating members comprise insulating spheres.

20. The apparatus of claim 1 wherein said insulating members comprise elongated cylindrical rods arranged in a direction generally parallel to the major surface areas of said electrodes.

* * * * *